US006595480B1

(12) United States Patent
Orlick

(10) Patent No.: US 6,595,480 B1
(45) Date of Patent: Jul. 22, 2003

(54) IN-LINE SKATE HOLDER

(76) Inventor: Jordan Orlick, 11443 Awenita Ct., Chatsworth, CA (US) 91311

( * ) Notice: Subject to any disclaimer, the term of this patent is extended or adjusted under 35 U.S.C. 154(b) by 0 days.

(21) Appl. No.: 09/630,174

(22) Filed: Aug. 1, 2000

Related U.S. Application Data

(60) Provisional application No. 60/174,979, filed on Jan. 6, 2000.

(51) Int. Cl.[7] ..... A63B 71/00

(52) U.S. Cl. ..... 248/346.01; 280/511; 482/51

(58) Field of Search ..... 248/346.01, 346.11, 248/688; 211/85.7, 22, 23, 24; 280/511, 825, 811, 11.3; 36/81; 482/51

(56) References Cited

U.S. PATENT DOCUMENTS

| | | | | | |
|---|---|---|---|---|---|
| 369,494 | A | * | 9/1887 | Bailey | |
| 2,353,809 | A | * | 7/1944 | Carson | 224/45 |
| 2,828,967 | A | * | 4/1958 | Vassanelli | 280/11.38 |
| 4,021,054 | A | | 5/1977 | Csutor | 280/11.37 R |
| 4,050,583 | A | * | 9/1977 | Szabo | 211/20 |
| 4,394,042 | A | * | 7/1983 | Smith | 294/163 |
| 5,036,986 | A | * | 8/1991 | Kral | 211/22 |
| 5,078,277 | A | * | 1/1992 | Tschritter | 211/20 |
| D356,991 | S | * | 4/1995 | Wooten | D12/413 |
| D368,403 | S | * | 4/1996 | Michalk et al. | D6/552 |
| 5,617,958 | A | * | 4/1997 | Laug et al. | 211/13 |
| 5,853,154 | A | * | 12/1998 | Ashley | 248/148 |
| 6,091,602 | A | * | 7/2000 | Helot | 361/686 |
| 6,193,082 | B1 | * | 2/2001 | Bartle | 211/85.7 |

* cited by examiner

*Primary Examiner*—Leslie A. Braun
*Assistant Examiner*—Steven Marsh
(74) *Attorney, Agent, or Firm*—Christie, Parker & Hale, LLP

(57) ABSTRACT

A skate holder for facilitating the putting on and taking off of skates includes a base, a pair of retaining walls defining a holder slot therebetween for receiving the skate, each retaining wall having an upper edge, a bottom surface of the holder slot positioned at an inclined angle in relation to the base, wherein the upper edges of the retaining walls have the same angle of inclination as the bottom surface of the holder slot with respect to the base, and a stop is positioned between the retaining walls at a lower end of the holder slot. The retaining walls are preferably positioned in a parallel facing relationship to each other and extend upwardly from the base at a perpendicular angle to the base.

6 Claims, 2 Drawing Sheets

IN-LINE SKATE HOLDER

CROSS REFERENCE TO RELATED APPLICATION

This application claims the benefit of U.S. Provisional Application No. 60/174,979, filed Jan. 6, 2000, the contents of which are hereby incorporated by reference.

FIELD OF THE INVENTION

The invention relates generally to the art of rollerblading and more particularly to aids and accessories for putting on and taking off rollerblades.

BACKGROUND OF THE INVENTION

When putting on in-line rollerblades or skates, a person must be able to maintain their balance along a single line of force while bending over to lace up or buckle the rollerblades. For many people this poses a problem because they are unable to balance their weight, while performing the necessary functions to securely fasten the rollerblade. Furthermore, the skater must place sufficient vertical force on the rollerblade to prevent the wheels of the rollerblades from rotating while the skater is fastening the skates. Many skaters are unable to exert the proper pressure on the blades resulting in a loss of their balance, followed by an inevitable fall when they are attempting to put on or take off their rollerblades. Another problem that arises during this process is that the boot falls over if the skater's weight is not centered properly on the boot resulting in an ankle injury caused by the twisting of the skater's ankle in the boot.

These problems are more common among new skaters who are not yet accustomed to balancing their weight on the rollerblades. The problem may also be exacerbated if a skater has difficulty bending over to fasten his or her skates. Some of the reasons for difficulty in bending over may be that the skater is portly, clumsy, or older and hence less nimble.

It is therefore desirable to provide an aid for putting on and taking off rollerblades safely and efficiently that can be used by skaters of all skill levels, regardless of size or shape.

It is also desirable to provide an aid that would reduce the risk of injury to a skater during the process of taking off and putting on rollerblades.

Finally, it is desirable to provide an aid that would allow those who have trouble bending over to reach their skates more comfortably.

SUMMARY OF THE INVENTION

It is an object of the present invention to provide an aid for putting on and taking off rollerblades safely and efficiently that can be used by skaters of all skill levels, regardless of size or shape.

It is also an object of the present invention to provide an aid that would reduce the risk of injury to a skater during the process of taking off and putting on rollerblades.

It is a further object of the invention to assist a skater who has trouble bending over to reach his or her skates more comfortably.

A skate holder for facilitating the putting on and taking off of rollerskates or rollerblades is provided having a base and a pair of retaining walls that define a holder slot therebetween for receiving the rollerskate or rollerblade. In the preferred embodiment, the bottom surface of the holder slot is positioned at an inclined angle in relation to the base and the upper edges of the retaining walls have the same angle of inclination as the bottom surface of the holder slot with respect to the base. A stop is positioned between the retaining walls at a lower end of the holder slot for preventing the skate from sliding out of the slot. The retaining walls are preferably positioned in a parallel facing relationship to each other and extend upwardly from the base at a perpendicular angle to the base.

DETAILED DESCRIPTION OF THE INVENTION

Figure 1:
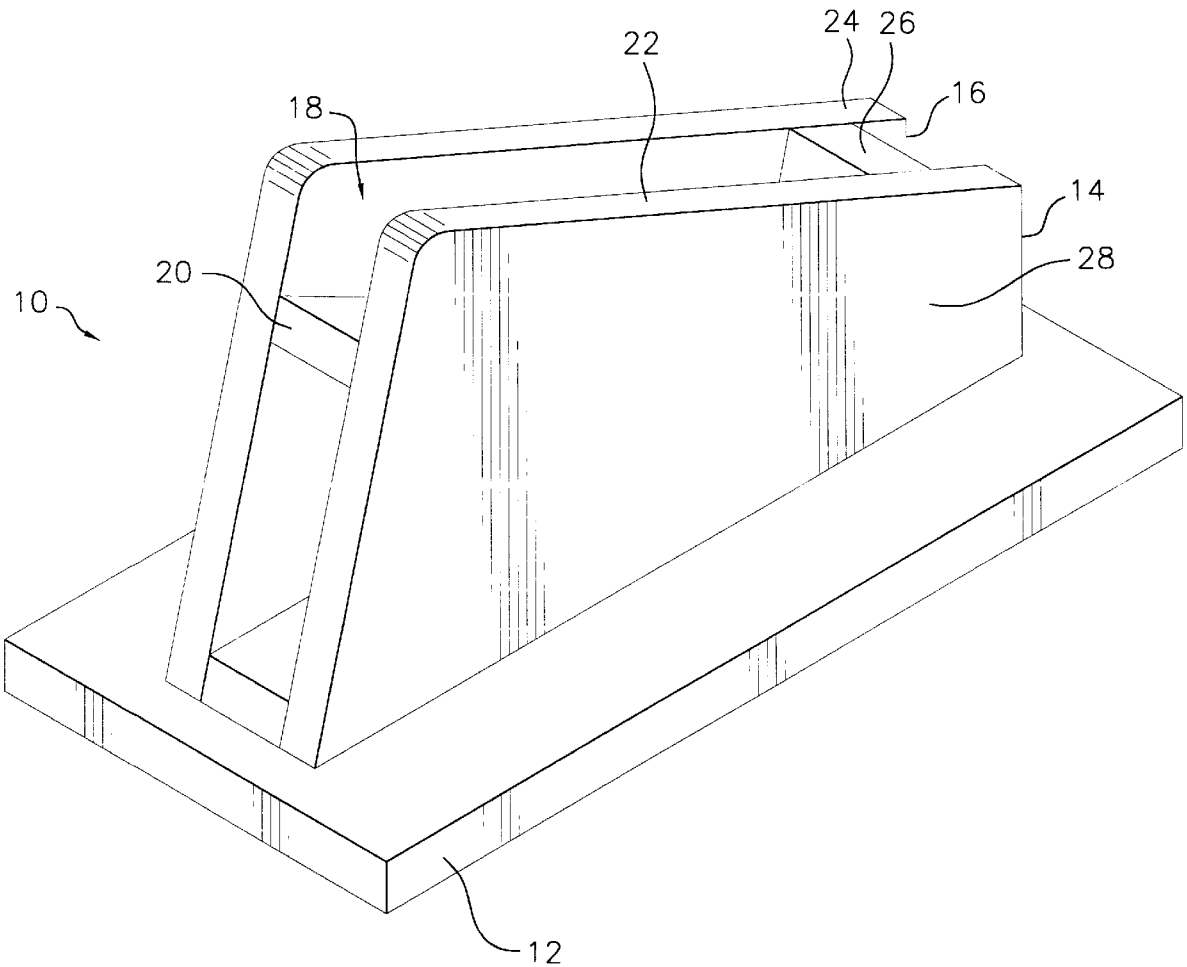
FIG. 1 is a perspective view of an embodiment of the in-line skate holder of the present invention.
Figure 2:
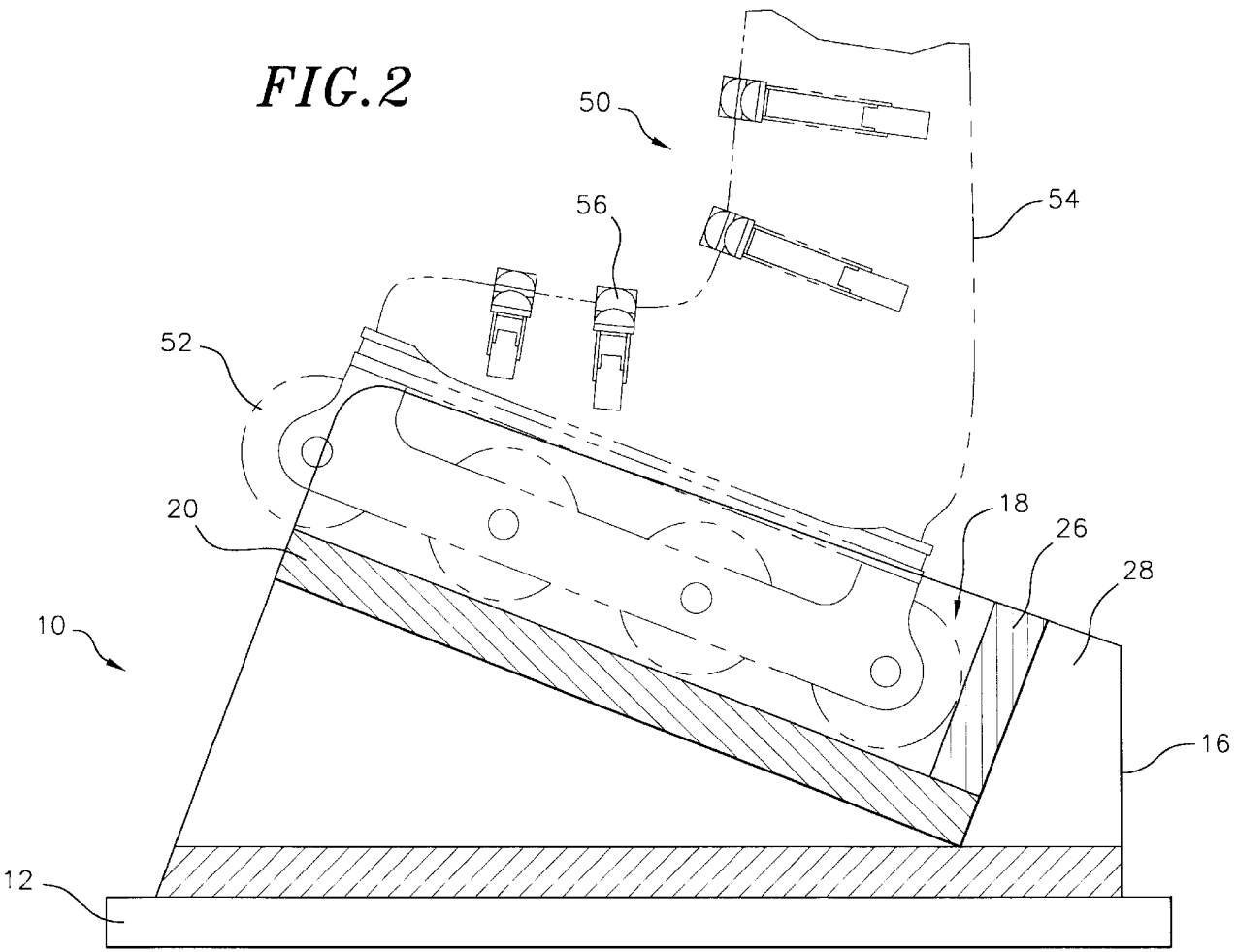
FIG. 2 is a cross-sectional side view of an embodiment of the in-line skate holder of the present invention, showing a rollerblade positioned in the holder slot.

FIGS. 1 and 2 illustrate an in-line skate holder 10 constructed according to the principles of the present invention. The terms skates, rollerskates and rollerblades are used interchangeably herein and the invention can be used with any variation of the skates, rollerskates or rollerblades. Skate holder 10 includes a base 12 that provides the holder with stability when the holder is placed on a surface. Base 12 should be sufficiently large such that it remains flat and does not turn over when the holder is in use. The holder may be constructed of any material that is sufficiently rigid to withstand the force exerted on it when a skater is using the holder. In one embodiment of the present invention, the holder is constructed of wood. Wood provides sufficient structural support for the holder while still maintaining minimal construction costs. The construction material is not limited to wood but can comprise any material that is sufficiently-rigid to provide the necessary support, including, but not limited to, plastic, fiberglass, metal, metal compound, or any combination thereof.

Extending transversely from base 12 are two retaining walls 14, 16. In the preferred embodiment, the retaining walls 14, 16 are positioned in a parallel facing relationship to each other and extend upwardly from base 12 at a perpendicular angle. Retaining walls 14, 16 define a holder slot 18, therebetween. The holder slot 18 is dimensioned to receive the wheels 52 of the rollerblade 50 and is preferably sufficiently large to allow the wheels 52 of the rollerblade 50 to contact the bottom surface 20 of the holder slot 18.

In the preferred embodiment of the present invention, the bottom surface 20 of the holder slot 18 is inclined in relation to base 12. The inclined bottom surface 20 elevates the boot 54 in respect to a floor upon which holder 10 is supported and facilitates lacing or unlacing, or buckling or unbuckling, of the boot 54 by a user. Furthermore, the inclined surface 20 positions the boot 54 such that it directly faces the user and brings the laces or buckles 56 closer to the user, thus making it easier to fasten the rollerblades 50.

The upper edges 22, 24 of the retaining walls 14,16 are preferably also inclined at the same angle of inclination as the bottom surface 20 of the holder slot 18. In the preferred embodiment of the present invention, a stop 26 is positioned between the retaining walls 14, 16 at the lower end 28 of the holder slot 18. When the skate is placed in the holder 10 at an inclined angle, there may be a tendency for the skate to slide or roll down the inclined bottom surface 20 of the holder slot 18. The placement of the stop 22 at the lower end 28 of the holder slot 18, prevents the skate from rolling out of the holder slot 18. Stop 22 is preferably manufactured from a rigid material and fixedly attached to the skate holder 10.

Although the skate holder of the present invention is described herein for use with rollerblades or rollerskates, the skate holder could be used to facilitate the putting on and removal of other sporting equipment as well, and therefore, the skate holder should not be limited to use in conjunction with rollerblades or rollerskates.

In a preferred embodiment of the present invention, the skate holder is used by placing a skate in the holder slot 18 such that the bottom, or wheels 52, of the skate is in-contact with the bottom surface 20 of the holder slot 18 and supported thereby. The boot 54 is preferably positioned in the holder slot 18 such that the buckles or laces 56 directly face the user to facilitate the fastening of the buckles or laces. The skate may be removed from the skate holder 10 when it is secured to the skater.

Similarly, when it is desired to remove the skate, the skate is positioned in the holder slot 18 such that the bottom, or wheels 52, of the skate is in contact with the bottom surface 20 of the holder slot 18 and supported thereby. The boot 54 is preferably positioned in the holder slot 18 such that the buckles or laces 56 directly face the user to facilitate the fastening of the buckles or laces. The skate is unbuckled or unlaced to allow a user to remove his or her foot from the skate, after which the skate is removed from the skate holder.

The skate holder of the present invention solves many of the problems facing skaters previously. Specifically, skaters no longer need to worry about balancing their weight on the skate while attempting to lace or buckle the skates. By placing the skate inside the skate holder, the skate is balanced between the retaining walls, eliminating the need for the skater to maintain his own balance. The skate is also brought closer to the skater making it easier to reach the skate from either a sitting or a standing position. This feature is especially useful for users that have trouble bending all the way to their feet. The inclined bottom surface also positions the laces or buckles of the skate in a facing relationship to the skater thus making it easier for the user to reach them. The ease and convenience of using the skate holder of the present invention allows a skater to put on his or her skates quickly and with minimal discomfort.

The skate holder also minimizes the risk of injury to the skater during the process of putting on or taking off of the skates. Specifically, the skate holder eliminates the risk of the skate falling over and twisting the skater's ankle because the wheels are held upright by the retaining walls. Furthermore, the stop at the lower end of the holder slot ensures that the skates are held in position and do not roll out from under the skater, causing the skater to fall. Accordingly, the skate holder of the present invention offers skaters a faster, more comfortable and more efficient manner of putting on and taking off skates.

Although the present invention has been described and is illustrated with respect to a preferred embodiment thereof, it is to be understood that it is not to be so limited since changes and modifications may be made therein which are within the full and intended scope of this invention as hereinafter claimed.

What is claimed is:

1. A skate accessory for facilitating the putting on and taking off of skates, the skates having a bottom protruding portion, the accessory comprising:

a base;

a pair of substantially parallel retaining walls defining a holder slot therebetween for receiving the bottom protruding portion of the skate, each retaining wall having an upper edge;

a bottom surface of the holder slot positioned at an inclined angle in relation to the base;

wherein the upper edges of the retaining walls have the same angle of inclination as the bottom surface of the holder slot with respect to the base; and a stop positioned between the retaining walls at a lower end of the holder slot.

2. A skate accessory in accordance with claim 1 wherein the retaining walls extend upwardly from the base at a substantially perpendicular angle to the base.

3. A skate accessory according to claim 1 wherein the stop is fixedly attached to at least one of the retaining walls.

4. A skate accessory according to claim 1 wherein the stop is fixedly attached in the holder slot at a perpendicular angle to the bottom surface of the holder slot.

5. A skate accessory according to claim 1 wherein the stop is fixedly attached in the holder slot at a perpendicular angle to the retaining walls.

6. A holder according to claim 1 comprising a wood material.

* * * * *